US006599091B2

(12) United States Patent
Nagle

(10) Patent No.: US 6,599,091 B2
(45) Date of Patent: Jul. 29, 2003

(54) MODULAR SUBMERSIBLE PUMP

(76) Inventor: James Nagle, 3458 Woodland Dr., Olympia Fields, IL (US) 60461

( * ) Notice: Subject to any disclaimer, the term of this patent is extended or adjusted under 35 U.S.C. 154(b) by 0 days.

(21) Appl. No.: 09/867,231

(22) Filed: May 29, 2001

(65) Prior Publication Data

US 2002/0182055 A1 Dec. 5, 2002

(51) Int. Cl.[7] ..... F04D 29/04; F04D 29/12

(52) U.S. Cl. ..... 415/229; 415/214.1; 415/104; 417/423.12

(58) Field of Search ..... 415/229, 230, 415/231, 214.1, 104; 417/423.3, 423.6, 423.12

(56) References Cited

U.S. PATENT DOCUMENTS

| | | | | |
|---|---|---|---|---|
| 2,218,003 A | | 10/1940 | Hawley, Jr. | |
| 2,745,351 A | * | 5/1956 | Zozulin | 415/113 |
| 3,153,382 A | | 10/1964 | Blarcom, Jr. | |
| 3,295,898 A | | 1/1967 | Finzel | |
| 3,704,960 A | * | 12/1972 | Zagar | 415/213.1 |
| 3,847,504 A | * | 11/1974 | Martin | 415/214.1 |
| 3,853,430 A | | 12/1974 | O'Rourke | |
| 3,957,403 A | * | 5/1976 | Sloan | 415/230 |
| 4,162,137 A | | 7/1979 | Bjerke | |
| 4,201,524 A | | 5/1980 | Wilkins | |
| 4,260,918 A | | 4/1981 | Engle | |
| 4,421,999 A | | 12/1983 | Beavers et al. | |
| 4,587,076 A | * | 5/1986 | Bonhomme | 415/230 |
| 4,588,353 A | | 5/1986 | Shibata et al. | |
| 4,768,888 A | | 9/1988 | McNaull | |
| 4,828,455 A | * | 5/1989 | Kinbara et al. | 415/131 |
| 4,966,532 A | | 10/1990 | Fengsheng | |
| 5,061,157 A | | 10/1991 | Arakawa | |
| 5,336,064 A | | 8/1994 | Lamers | |
| 5,367,214 A | | 11/1994 | Turner, Jr. | |
| 5,425,624 A | | 6/1995 | Williams | |
| 5,499,901 A | * | 3/1996 | Rockwood | 415/230 |
| 5,571,001 A | | 11/1996 | Fukuda et al. | |
| 5,659,214 A | | 8/1997 | Guardiani et al. | |
| 5,775,877 A | | 7/1998 | Genz | |
| 5,795,135 A | | 8/1998 | Nyilas et al. | |
| 5,846,049 A | | 12/1998 | DuPuis | |
| 5,923,111 A | | 7/1999 | Eno et al. | |
| 6,056,511 A | | 5/2000 | Kennedy et al. | |
| 6,073,934 A | | 6/2000 | Fondelius | |
| 6,079,958 A | | 6/2000 | Qandil | |

FOREIGN PATENT DOCUMENTS

| | | |
|---|---|---|
| DE | 195 41 195 A1 | 5/1997 |

* cited by examiner

*Primary Examiner*—Edward K. Look
*Assistant Examiner*—Igor Kershteyn
(74) *Attorney, Agent, or Firm*—Wallenstein & Wagner, Ltd.

(57) ABSTRACT

The present invention provides a modular submersible pump comprising a motor section, bearing section and a pump section. The motor section includes a motor frame and a motor shaft. The bearing section has a bearing frame removably connected to the motor frame of the motor section. A removable cartridge is disposed within the bearing frame and has a shaft extension connected to the motor shaft. The cartridge includes at least one bearing and at least one seal in communication with the shaft extension. The pump section has a pump case removably connected to the bearing frame and having an impeller disposed therein. The impeller is connected to the shaft extension of the removable cartridge.

24 Claims, 3 Drawing Sheets

MODULAR SUBMERSIBLE PUMP

TECHNICAL FIELD

The present invention is related to the field of pumps. More particularly, the present invention is related to submersible pumps.

BACKGROUND OF THE INVENTION

Submersible pumps are designed to allow both the pump section and the motor section to be submersed in a liquid or slurry, such as, for example, waste water contaminated with abrasive solids or sewage. In general, the original concept of the submersible pump comprised two basic functional sections, a pump section and a drive section. The pump section typically comprises a casing or housing having an impeller disposed therein, which transfers energy to the fluid. The casing includes a suction opening and a discharge opening to facilitate fluid flow through the pump. The drive section typically comprises a motor having a motor shaft that provides rotational movement to the impeller.

In the original submersible pump concept, the pump section and the drive section are connected in close proximity to each other and completely submerged in the liquid being pumped. An electrical cable is typically extended to a power supply of the motor above the surface of the liquid. The motor components, such as the rotor, stator and other electrical components and connections are typically sealed in a watertight housing. A sealing arrangement is also provided to accommodate the motor shaft that extends through an aperture in the housing.

A drawback to the original concept of submersible pumps was the difficulty in determining a failure in the sealing arrangement. Since the pump is submerged, a seal failure was not detected until the motor had shorted out due to the liquid migrating from the pump section to the motor housing. Therefore, in later designs, an intermediate chamber was incorporated between the motor housing and the pump section. The chamber is typically filled with a barrier fluid and includes two sealing arrangements disposed therein. One of the sealing arrangements is utilized at one end near the motor housing to keep the barrier fluid out of the motor housing (also commonly referred to as a motor seal, inner seal, or upper seal in a vertical pump arrangement). The other sealing arrangement is utilized at the other end to keep the pumped liquid out of the chamber (also commonly referred to as a chamber seal, outer seal, or lower seal in a vertical pump arrangement). The barrier fluid acts as a lubricant and coolant for the sealing arrangements. Additionally, the barrier fluid is part of a moisture sensing system. Since the barrier fluid is typically a nonconductive mineral, such as an oil, or a synthetic hydrocarbon, a change in conductivity caused by the introduction of a pumped liquid, which is typically conductive, can be measured to indicate an outer seal failure.

The introduction of the intermediate chamber section led to other problems. The added length of the intermediate chamber required additional length of the motor shaft. This additional length of the shaft created an increased distance from the bearings of the motor to the impeller (typically referred to as overhang). In submersible pump applications, loads on the impeller, which cause loads on the motor shaft, can be significant. The loads cause deflection of the shaft and create stability problems, which result in increased deterioration of the sealing elements in the chamber section. The deflection of the shaft is dependent on many factors, including, the shaft diameter and distance between the support bearings of the motor, the shaft diameter and overhang (distance) from the bearing closest to the impeller to the load point at the impeller, and the magnitude of the radial load at the impeller. Since slurry pump designs provide larger and more robust impeller designs, this results in higher radial impeller loads. While the typical submersible motor has a support bearing arrangement for the motor shaft, this arrangement is often inadequate for these increased loads. Additionally, since the motor shaft serves as both a motor shaft and a pump shaft, other components of the motor need to be designed to handle the increased loads. In many cases, it is not practical to provide a commercially viable product that can solve the problems as explained above.

Certain other drawbacks exist with present industrial submersible pumps. Most notable is the lack of modularity with respect to the functional pump sections. In these designs, the motor is not independently separable from the remaining sections of the pump. Thus, even if the motor is the only component that needs to be repaired or replaced, the entire bearing, seal and shaft assembly must remain with the motor. Additionally, these pumps do not have independently separable bearing and sealing arrangements. Without an increased level of modularity, various components of these pumps cannot be quickly and individually replaced in lieu of completely replacing the pump or significantly repairing sections of the pump.

The lack of modularity also creates other maintenance issues. Many industrial and municipal plants no longer perform in-house maintenance particularly on electrical apparatus. Since the motor, motor shaft (which extends from the motor to the pump section) and seals are not designed to be separable in a modular sense, any failure of the pump, whether the failure ends up to be an electrical failure or a mechanical failure, generally results in the entire pump being sent to a motor rewind or repair shop. Due to lack of modularity, however, the motor shop must also be experienced in evaluation and repair of mechanical seals, shafts, bearings and other intricate components. Many of the motor repair shops cannot adequately provide repair for all of the pump components. They typically do not have the proper expertise to provide optimal quality repair for all components. This affects the cost, quality and turn around time for many repairs.

Another drawback with existing submersible pump designs for heavy duty applications is the sealing arrangements within the intermediate chamber. Most designs incorporate a tandem seal arrangement of an inner seal (motor seal) and an outer seal (chamber seal). With a very common arrangement, the outer seal has a stationary face at its top section and a rotary section including a rotary face that hangs down below the top section. A rotary spring is also included in the rotary section. However, because the spring is incorporated in the rotary section, it is susceptible to wear and fouling by material found within the liquid or slurry being pumped. These spring components are fragile. While some designs incorporate a guard or deflector around the rotary seal components, these designs are not completely effective. Another problem with tandem seal arrangements is that the lower seal is typically inadequately lubricated and cooled by the fluid within the chamber when the sump level drops below the outer (chamber) seal faces, thus causing seal failure. Other designs invert the lower seal in a back-to-back arrangement so that the rotary seal components are disposed within the intermediate chamber. However, these designs still place the stationary face at the bottom, where solid material can become lodged between the shaft and the stationary face. In addition, with this seal face arrangement on the lower seal, centrifugal force can also force particles from the fluid being pumped through the seal faces and into the oil chamber.

Thus, there remains a need for an improved submersible pump that can be used for in-plant industrial applications. Bore-hole pumps, for example, are longer/thinner pump designs that are designed to be inserted into wells. As the wells are typically narrow, the pumps have lateral constraints and therefore must have a slender, thinner design. Because of the required length of the pump, the pump must also have multiple stages to successfully pump fluid out of the well. A submersible pump suitable for in-plant industrial applications does not require multiple stages nor does it have lateral constraints. In-plant pumps, however, are often used in shallow sumps which have vertical constraints. The pump must be submersed in the shallow sumps for proper operation. The pumps, therefore, cannot have a long/slender design such as bore-hole pumps. Due to these requirements, in-plant pumps have lacked a desirable level of modularity to improve pump operation and maintenance.

The present invention is provided to solve these problems as well as other problems.

SUMMARY OF THE INVENTION

The present invention is directed to a modular submersible pump comprising a motor including a motor frame and a motor shaft, a bearing frame removably connected to the motor frame of the motor, a removable cartridge disposed within the bearing frame and having a shaft extension connected to the motor shaft. The cartridge includes at least one bearing and at least one seal in communication with the shaft extension. A pump case is removably connected to the bearing frame and having an impeller disposed therein, the impeller connected to the shaft extension of the removable cartridge.

According to another aspect of the invention, the removable cartridge disposed within the bearing frame includes a bearing housing having an interior chamber, a seal housing having an interior chamber and removably connected to the bearing housing, and a shaft extension connected to the motor shaft and extending through the interior chambers of the bearing housing and the seal housing. The bearing housing has at least one axial bearing and at least one radial bearing disposed therein and capable of bearing against the shaft extension. The seal housing has at least one seal disposed therein, the seal including a rotary seal face and a stationary seal face, the rotary seal face connected to a shaft sleeve concentrically disposed around the shaft extension, the stationary seal face being spring-loaded against the rotary seal face and attached to the interior portion of the seal housing.

According to yet another aspect of the invention, the modular pump further includes an expeller rotor connected to the shaft extension for rotation therewith, the expeller rotor is disposed adjacent to the seal housing and the pump case. The expeller rotor acts to dispel matter within a pumping liquid away from the seal housing.

According to yet another aspect of the invention, the interior portion of the seal housing has an axial length and the interior portion of the bearing housing has an axial length, the axial length of the interior portion of the seal housing being less than the axial length of the interior portion of the bearing housing. The short length of the seal housing minimizes shaft overhang from a lower radial bearing in the bearing housing to the impeller.

These and other aspects of the present invention will be readily apparent after review of the detailed description in conjunction with the drawings.

DETAILED DESCRIPTION OF THE PREFERRED EMBODIMENT

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
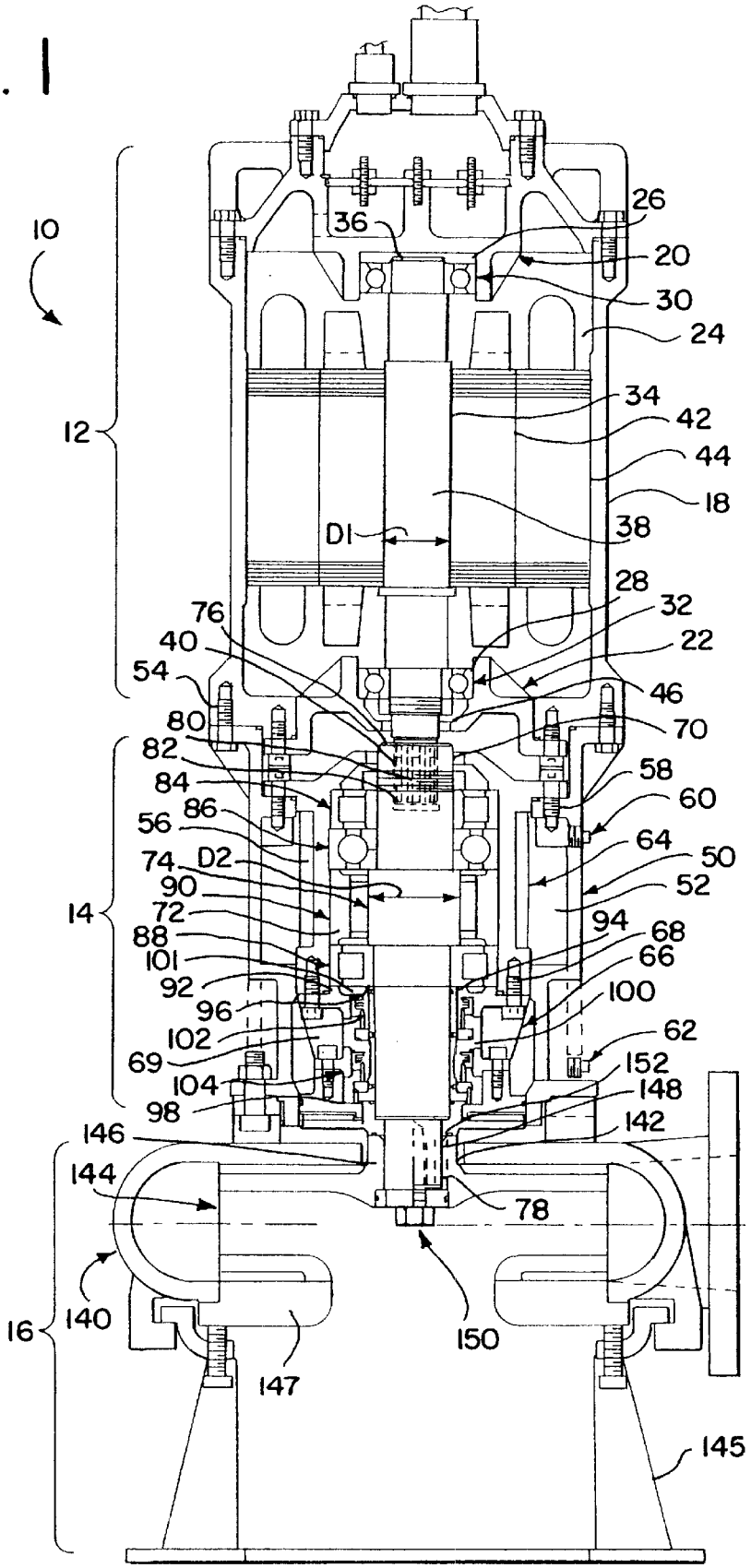
FIG. 1 is a cross-sectional view of an embodiment of a submersible pump in accordance with the present invention.

FIG. 1 shows a submersible pump 10 of the present invention. The pump 10 generally includes three functional sections, a motor section 12, a bearing section 14, and a pump section 16. The motor section 12 includes a motor frame 18, an upper motor bearing housing 20, and a lower motor bearing housing 22 that define an interior portion 24 of the motor section 12. The upper motor bearing housing 20 includes an upper bearing seat 26 and the lower motor bearing housing 22 includes a lower bearing seat 28. An upper radial bearing 30 is disposed within the upper bearing seat 26 and a lower axial bearing 32 is disposed within the lower bearing seat 28. A motor shaft 34 having a proximal end 36, a central portion 38, and a distal end 40 is disposed within the motor section 12. The motor shaft 34 has a first diameter D1. The motor section 12 has a motor rotor 42 and a motor stator 44 disposed around the central portion 38 of the motor shaft 34 within the motor frame 18. The motor shaft 34 is disposed within the motor frame 18 such that the upper radial bearing 30 is disposed near the proximal end 36 of the motor shaft 34 and the lower axial bearing 32 is disposed near the distal end 40 of the motor shaft 34. A motor shaft aperture 46 in the lower motor bearing housing 22 allows the motor shaft 34 to pass therethrough for coupling to the bearing section 14.

The bearing section 14 includes a bearing frame 50 having an interior portion 52. The bearing frame 50 is attached to the motor frame 18 via mechanical fasteners 54. A removable cartridge 56 is disposed within the interior portion 52 of the bearing frame 50 and removably attached thereto via mechanical fasteners 58. An oil fill plug 60 and an oil drain plug 62 in the bearing frame 50 allow the interior portion 52 to be filled with oil or other non-conductive lubricant.

Figure 2:
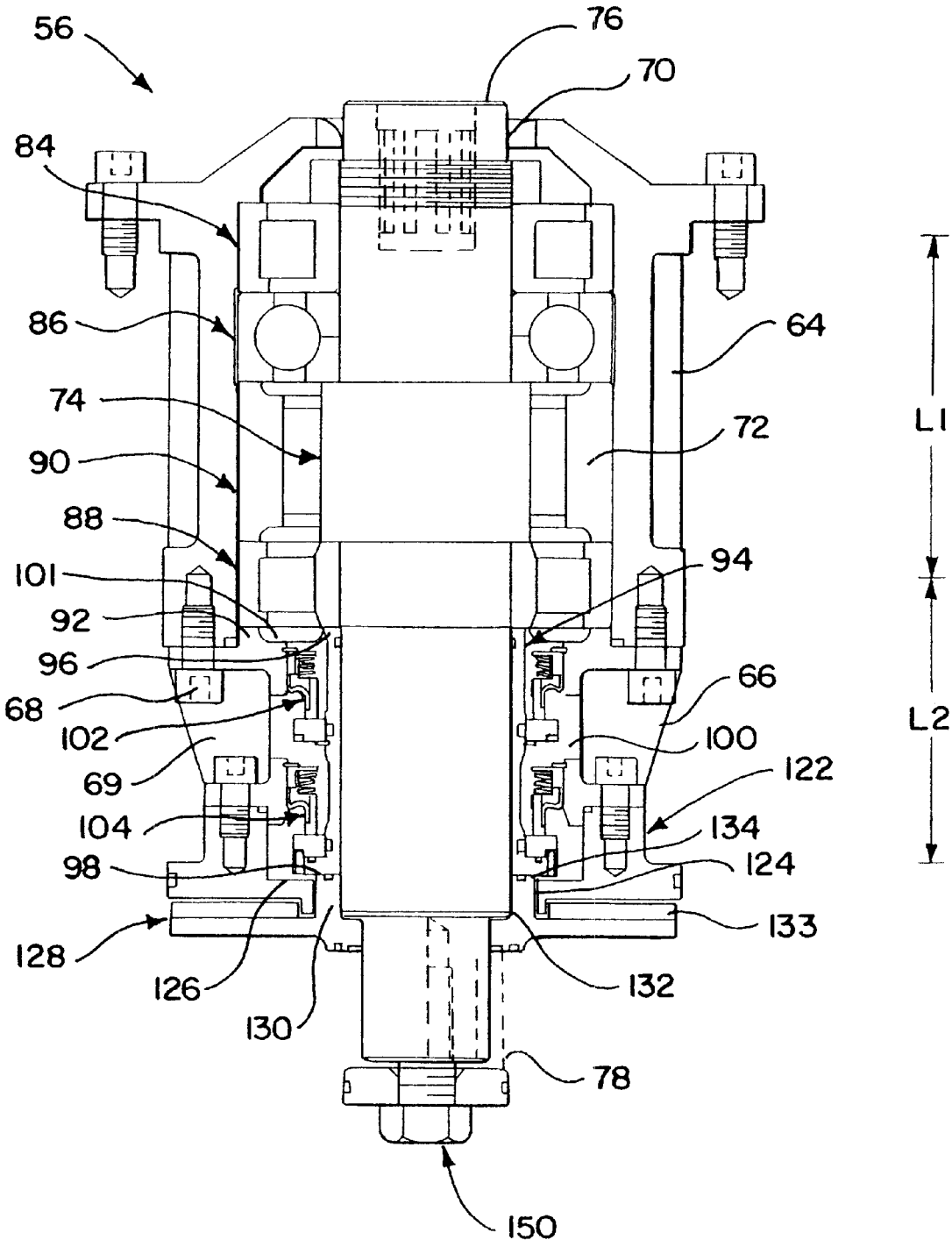
FIG. 2 is a cross-sectional view of a removable cartridge of the submersible pump in FIG. 1.
Figure 3:
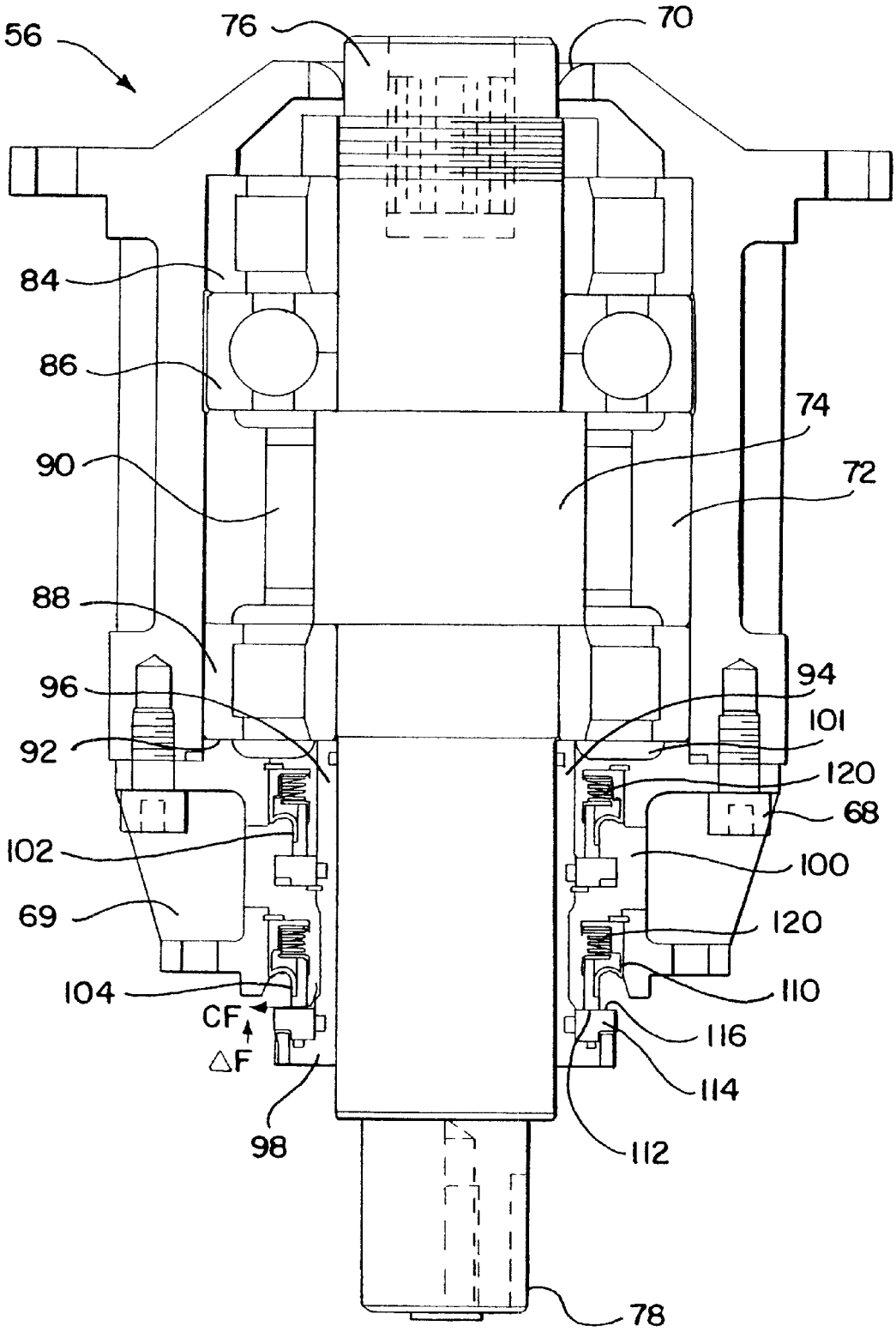
FIG. 3 is a larger cross-sectional view of the removable cartridge shown in FIG. 2 without a seal cover and expeller rotor.

FIGS. 2 and 3 show the removable cartridge 56. The removable cartridge 56 includes a bearing housing 64 and a seal housing 66 attached to each other via mechanical fasteners 68. Thus, the bearing housing 64 and the seal housing 66 are removable sub-cartridges of the removable cartridge 56. The seal housing 66 includes a plurality of radially disposed fins 69. The fins 69 are spaced about a shaft 74 to be described. When the pump rotates, the fins 69 help prevent vortexing of the circulating oil. The bearing housing 64 includes an upper shaft aperture 70 and an interior portion 72. A shaft 74 having a proximal end 76 and a distal end 78 is disposed within the interior portion 72. As shown in FIG. 1, the proximal end 76 of the shaft 74 extends through the upper shaft aperture 70 and includes a female splined connection 80 that engages with a male splined coupling 82 disposed on the distal end 40 of the motor shaft 34. The shaft 74 extends downwardly through the removable cartridge 56 to the pump section 16. It is understood that the male and female ends can be reversed. It is further understood that other connection methods are possible such as flexible or solid couplings.

Referring again to FIGS. 2 and 3, an upper radial bearing 84 is disposed within the interior portion 72 of the bearing housing 64 and adjacent to the upper shaft aperture 70. An axial bearing 86 is disposed about the shaft 74 and positioned adjacent the upper radial bearing 84. A lower radial bearing 88 is disposed about the shaft 74 and spaced from the axial bearing 86 via a spacer sleeve 90 disposed therebetween. The lower radial bearing 88 seats against a surface 92 of the seal housing 66 to maintain axial positioning of all of the bearings about the shaft 74.

As shown in FIGS. 1–3, a removable shaft sleeve 94 having a proximal end 96 and a distal end 98 is disposed about the shaft 74 within an interior portion 100 of the seal housing 66 such that the proximal end 96 of the shaft sleeve 94 is immediately adjacent the lower radial bearing 88. A grease shield 101 is disposed below the lower radial bearing 88 to prevent grease within the bearing housing 64 from entering the seal housing 66.

An inner mechanical seal 102 is disposed within the interior portion 100 of the seal housing 66 below to the proximal end 76 of the shaft 74. An outer mechanical seal 104 is disposed within the interior portion 100 of the seal housing 66 just above the distal end 78 of the shaft 74. A pair of moisture sensors (not shown) are in communication with the barrier fluid within the interior portion 52 of the bearing frame 50 to provide a seal failure detection system. The fluid is nonconductive. The moisture sensor senses a change in conductivity of the fluid if the pumping liquid (which is conductive) is introduced into the interior portion 52 of the bearing frame 50. Thus, if the outer mechanical seal 104 fails, the moisture sensor will detect the failure.

As best shown in FIG. 3, the inner and outer mechanical seals 102 and 104 each include a stationary portion 110 having a stationary face 112 and a rotary portion 114 having a rotary face 116. The stationary portion 110 is spring-loaded via a spring 120 such that the stationary face 112 bears against the rotary face 116. Multiple springs 120 could also be used. As best shown in FIG. 2, a seal cover 122 having a shaft aperture 124 is attached to the seal housing 66 adjacent to the distal end 98 of the shaft sleeve 94. An expeller rotor 128 having an annular collar 130 and a shaft aperture 132 therethrough is disposed immediately adjacent to the seal cover 122 such that the annular collar 130 is disposed within the shaft aperture 124 of the seal cover 122. The expeller rotor 128 also includes expeller blades 133. A bearing surface 134 of the annular collar 130 of the expeller rotor 128 bears against the distal end 98 of the shaft sleeve 94.

As shown in FIG. 2, the interior portion of the bearing housing 64 has an axial length L1. The interior portion of the seal housing 66 has an axial length L2. The axial length L2 of the interior portion of the seal housing 66 is less than the axial length L1 of the interior portion of the bearing housing 64. The short length of the seal housing 66 minimizes the shaft overhang from the lower radial bearing in the bearing housing to the impeller. Minimizing shaft overhang improves the stability of the overall shaft and reduces the shaft deflection through the seals.

As shown in FIG. 1, the pump section 16 generally includes a pump case 140 having a shaft aperture 142 to accommodate the shaft 74 and a pump impeller144 disposed therein. The impeller 144 is attached to the distal end 78 of the shaft 74. The impeller 144 includes an annular collar 146 and an aperture therethrough 148 to accommodate the shaft 74. An impeller lock screw 150 attaches the impeller 144 to the shaft 74 within the pump case 140. The annular collar 146 of the impeller 144 extends through the shaft aperture 142 in the pump case 140. The annular collar 146 of the impeller 144 also includes a bearing surface 152 that bears against the expeller rotor 128 to maintain its position relative to the seal cover 122.

Several advantages of the present invention are readily apparent. First, the motor section 12 is independently separable from the bearing section 14. The motor section 12 can be removed for replacement or repair by merely removing the mechanical fasteners 54. When the motor section 12 is removed, the motor section 12 remains completely sealed and intact for easy handling. If a seal or a bearing in the bearing section fails, the motor section 12 and the impeller 144 can be easily removed to allow removal of the removable cartridge 56. The motor is removed by removing the mechanical fasteners 54. Once a mounting stand 145 and suction cover 147 are removed, the impeller 144 is removed by removing the impeller lock screw 150. The removable cartridge 56 can then be removed by removing the mechanical fasteners 58. A spare cartridge can be quickly ad easily installed to reduce down time. Otherwise, the removable cartridge 56 can be repaired on site or exchanged by the manufacturer. Thus, the modularity of the pump 10 eliminates the requirement of transporting both the motor section 12 and the bearing section 14 when only one needs repair.

In addition, since the bearing section 14 is completely independent of the motor section 12, the shaft diameters, bearing types and sizes, bearing spacing and all other design elements can be optimized to properly accommodate all of the pump axial and radial loads to provide superior component life and seal durability. For example, because the bearing section 14 is separate from the motor section 12, the bearing section shaft diameter D2 can be sized larger than the motor shaft diameter D1 as the bearing section shaft diameter D2 does not interfere with the internal motor windings which dictate the size of the motor shaft diameter D1. A larger bearing section shaft diameter allows for a more robust design and less deflection of the shaft during operation which can substantially improve seal performance. Thus, the shaft is more stiff and, therefore, more stable. Such design also allows for less shaft overhang from the bearing section further adding to the stability of the shaft. The motor section 12 is simplified and made more reliable by enabling the motor shaft 34 and motor bearings 30 and 32 to service only the modest load demands of the motor itself and avoid the additional design elements required by pumps having motors with shafts that act as both the motor shaft and the pump shaft. Separate modular components also allows greater flexibility in selecting the components of the motor section 12 and the bearing section 14. For example, only certain components of the bearing section 14 would have to be constructed of the more expensive corrosion resistant alloys while other components could be constructed of less expensive carbon steel or cast iron.

Another advantage of the present invention is the sealing arrangement. The seals 102 and 104 have spring-loaded, stationary seal faces 112 mounted in the seal housing 66 and axially-fixed, rotary faces 116 mounted on the removable shaft sleeve 94. By locating the springs 120 on the stationary portion 110 of the seals 102 and 104, these fragile components are entirely inside the interior portion of the bearing frame and completely isolated from wear, deposits or jamming. In addition, stationary springs provide better and more stable face loading between the stationary seal faces 112 and the rotary seal faces 116. The seal arrangement also allows for a condensed design, therefore, decreasing the axial distance of the seals. This also allows for a short shaft design increasing the stability of the shaft and seal durability.

Yet another advantage of the present invention involves improved control of fluid flow near the seal housing 66. In this modified tandem seal configuration (FIG. 3), the effects of centrifugal force now act on the oil within the interior portion 52 of the bearing portion 50 to force any clean oil outwardly against the interface of the stationary faces and rotary faces of the seals (see arrow CF), as opposed to certain prior art configurations that allowed dirty pumping fluid to migrate between the shaft and seal wherein the centrifugal force could act on it to force the dirty fluid outwardly through the seal. In this configuration, the centrifugal force acts on the oil outwardly against any inward migration of the dirty pumping fluid through the seals (see arrow DF). Thus, the centrifugal force acts on the oil and forces the oil towards the mating seal faces 112 and 116. This makes it more difficult for the dirty fluid to enter between the seal faces 112 and 116. Additionally, the blades 133 of the expeller rotor 128 pull the dirty fluid away from the outer seals 104 as the expeller rotor 128 rotates, thus making it more difficult for the dirty fluid to penetrate between the seal faces 112 and 116. Also, the radially disposed fins 69 act as baffles to prevent vortex flow of the oil, thus keeping the oil from pulling away from the seals 102 and 104.

Consistent with the modular aspects of the pump 10, the seals and associated components can also be removed from the bearing housing easily. After the removable cartridge 56 is removed from the bearing frame, the seal housing, seals and associated components such as the shaft sleeve and the seal cover can be removed from the shaft as a single sub-assembly and replaced or repaired. This capability provides rapid maintenance turnaround if only the seals are damaged and avoids the need to handle the fragile individual components of the seals. Another advantage of the present invention is that the interior portion 100 of the seal housing 66 has an axial length that is less than an axial length of the interior portion 72 of the bearing housing 64. The short length of the seal housing 66 minimizes overhang of the shaft 74 from the lower radial bearing 88 in the bearing housing 64 to the impeller 144. The minimal overhang provides a more stable and durable pump and sealing system.

While the specific embodiments have been illustrated and described, numerous modifications come to mind without significantly departing from the spirit of the invention and the scope of protection is only limited by the scope of the accompanying claims.

What is claimed is:

1. A modular submersible pump comprising:

a motor including a motor frame and a motor shaft;

a bearing frame removably connected to the motor frame of the motor;

a removable cartridge disposed within the bearing frame and having a shaft extension connected to the motor shaft, the cartridge including at least one bearing and at least one seal in communication with the shaft extension; and a pump case removably connected to the bearing frame and having an impeller disposed therein, the impeller connected to the shaft extension of the removable cartridge.

2. The modular pump of claim 1, wherein the removable cartridge includes a bearing housing and a seal housing removably connected to each other.

3. The modular pump of claim 2, wherein the bearing housing includes an axial bearing and a radial bearing disposed therein.

4. The modular pump of claim 2, wherein the seal housing is disposed adjacent to the pump case and includes an inner mechanical seal and an outer mechanical seal.

5. The modular pump of claim 4, further comprising an expeller rotor disposed adjacent to the seal housing and connected to the shaft extension.

6. The modular pump of claim 2 further comprising a shield positioned between the bearing housing and the seal housing.

7. The modular pump of claim 2 wherein the seal housing has a plurality of radially spaced fins.

8. The modular pump of claim 1 wherein the motor shaft has a first diameter and the shaft extension has a second diameter, the first diameter being smaller than the second diameter.

9. A modular submersible pump comprising:

a motor including a motor frame and a motor shaft;

a bearing frame removably connected to the motor frame of the motor;

a removable cartridge disposed within the bearing frame, the cartridge including:

a bearing housing having an interior portion;

a seal housing having an interior portion and removably connected to the bearing housing; and a shaft extension connected to the motor shaft and extending through the interior portions of the bearing housing and the seal housing;

the bearing housing having at least one axial bearing and at least one radial bearing disposed therein and capable of bearing against the shaft extension;

the seal housing having at least one seal disposed therein, the seal including a rotary seal face and a stationary seal face, the rotary seal face connected to a shaft sleeve concentrically disposed around the shaft extension, the stationary seal face being spring-loaded against the rotary seal face and attached to the interior portion of the seal housing; and a pump case removably connected to the bearing frame and having an impeller disposed therein, the impeller connected to the shaft extension of the removable cartridge.

10. The modular pump of claim 9, wherein the seal housing includes a seal cover removably connected thereto.

11. The modular pump of claim 9, further including an expeller rotor connected to the shaft extension for rotation therewith, the expeller rotor disposed adjacent to the seal housing and the pump case.

12. The modular pump of claim 11, wherein the shaft extension extends through a shaft aperture within the seal housing and a portion of the expeller rotor is disposed within the shaft aperture.

13. The modular pump of claim 11, wherein the interior portion of the seal housing has an axial length and the interior portion of the bearing housing has an axial length, the axial length of the interior portion of the seal housing being less than the axial length of the interior portion of the bearing housing.

14. A cartridge for a submersible pump, the submersible pump including a motor unit having a motor shaft, a pump case having an impeller disposed within a pump chamber, and a bearing frame intermediately disposed between and removably connected to the motor unit and the pump case, the cartridge removably connected to and disposed within the bearing frame, the cartridge comprising:

a bearing housing having an interior portion;

a seal housing having an interior portion and removably connected to the bearing housing; and a shaft extension extending through the interior portions of the bearing housing and the seal housing, the shaft extension having a first end and a second end, the first end of the shaft extension adapted to be connected to the motor shaft of the motor unit and the second end adapted to be connected to the impeller disposed within the pump case;

the bearing housing having at least one axial bearing and at least one radial bearing disposed therein and engaging the shaft extension;

the seal housing having a seal disposed therein, the seal having a rotary seal face and a stationary seal face, the rotary seal face connected to the shaft extension, the stationary seal face being connected to the seal housing and being spring-loaded against the rotary seal face.

15. The cartridge of claim 14 further comprising a shaft sleeve concentrically disposed around the shaft extension, the rotary seal face being connected to the shaft extension through the shaft sleeve.

16. The cartridge of claim 14 wherein the seal housing has a plurality of radially spaced fins.

17. The cartridge of claim 14 further comprising an expeller rotor concentrically disposed around the shaft extension and positioned generally between the seal housing and the pump case.

18. The cartridge of claim 14 wherein the bearing housing includes a first radial bearing, an axial bearing, and a second radial bearing disposed therein to engage the shaft extension.

19. The cartridge of claim 14 further comprising a shield positioned between the bearing housing and the seal housing.

20. A modular submersible pump comprising:

a motor including a motor frame and a motor shaft;

a bearing frame removably connected to the motor frame of the motor;

a removable cartridge disposed within the bearing frame, the cartridge including:

a bearing housing having an interior portion;

a seal housing having an interior portion and removably connected to the bearing housing, the seal housing having a plurality of radially disposed fins;

a grease shield positioned between the bearing housing and the seal housing; and a shaft extension connected to the motor shaft and extending through the interior portions of the bearing housing and the seal housing;

the bearing housing having at least one axial bearing and at least one radial bearing disposed therein and capable of bearing against the shaft extension;

the seal housing having an inner seal and an outer seal, each seal having a rotary seal face and a stationary seal face, the rotary seal face connected to a shaft sleeve concentrically disposed around the shaft extension, the stationary seal face being spring-loaded against the rotary seal face and attached to the interior portion of the seal housing; and a pump case removably connected to the bearing frame and having an impeller disposed therein, the impeller connected to the shaft extension of the removable cartridge.

21. A modular submersible pump comprising:

a motor including a motor frame and a motor shaft;

an enclosed bearing frame defining an interior cavity and removably connected to the motor frame of the motor;

a removable self-contained bearing and seal cartridge disposed within the interior cavity of the bearing frame and having a shaft extension connected to the motor shaft, the cartridge including at least one bearing and at least one seal in communication with the shaft extension and enclosed within the cartridge; and a pump case removably connected to the bearing frame and having an impeller disposed therein, the impeller connected to the shaft extension of the removable cartridge.

22. A modular submersible pump comprising:

a motor including a motor frame and a motor shaft;

a bearing frame removably connected to the motor frame of the motor;

a removable cartridge disposed within the bearing frame and having a shaft extension connected to the motor shaft, the cartridge including a bearing housing and a seal housing removably connected to each other, the bearing housing containing at least one bearing and the seal housing containing an inner and an outer mechanical seal, the bearing and seals in communication with the shaft extension; and a pump case removably connected to the bearing frame and having an impeller disposed therein, the impeller connected to the shaft extension of the removable cartridge.

23. A modular submersible pump comprising:

a motor including a motor frame and a motor shaft;

a bearing frame removably connected to the motor frame of the motor;

a removable cartridge disposed within the bearing frame and having a shaft extension connected to the motor shaft, the cartridge including at least one bearing and at least one seal in communication with the shaft extension; and a pump case removably connected to the bearing frame and having an impeller disposed therein, the impeller connected to the shaft extension of the removable cartridge;

wherein the removable cartridge includes a bearing housing and a seal housing removably connected to each other and wherein the seal housing is disposed adjacent to the pump case and includes an inner mechanical seal and an outer mechanical seal.

24. A cartridge for a submersible pump, the submersible pump including a motor unit having a motor shaft, a pump case having an impeller disposed within a pump chamber, and a bearing frame intermediately disposed between and removably connected to the motor unit and the pump case, the cartridge removably connected to and disposed within the bearing frame, the cartridge comprising:

a bearing housing having an interior portion;

a seal housing having an interior portion and removably connected to the bearing housing;

a shaft extension extending through the interior portions of the bearing housing and the seal housing, the shaft extension having a first end and a second end, the first end of the shaft extension adapted to be connected to the motor shaft of the motor unit and the second end adapted to be connected to the impeller disposed within the pump case; and a shaft sleeve concentrically disposed around and connected to the shaft extension;

the bearing housing having at least one axial bearing and at least one radial bearing disposed therein and engaging the shaft extension;

the seal housing having a seal disposed therein, the seal having a rotary seal face and a stationary seal face, the rotary seal face connected to the shaft sleeve, the stationary seal face being connected to the seal housing and being spring-loaded against the rotary seal face.

* * * * *